United States Patent [19]

Kerr

[11] Patent Number: 4,638,492

[45] Date of Patent: Jan. 20, 1987

[54] ROOF ASSEMBLY FOR AN ELECTRIC ARC FURNACE

[75] Inventor: Robert L. Kerr, Poland, Ohio

[73] Assignee: Wean United, Inc., Pittsburgh, Pa.

[21] Appl. No.: 818,441

[22] Filed: Jan. 13, 1986

[51] Int. Cl.[4] ..... F27D 1/02

[52] U.S. Cl. ..... 373/74; 432/238

[58] Field of Search ..... 373/73, 74, 44; 432/250, 237, 238

[56] References Cited

U.S. PATENT DOCUMENTS

| | | | |
|---|---|---|---|
| 1,922,312 | 8/1933 | Mansfield | 373/74 |
| 4,021,603 | 5/1977 | Nanjyo et al. | 373/74 |
| 4,063,028 | 12/1977 | Longenecker | 373/74 |
| 4,091,228 | 5/1978 | Brown, Jr. et al. | 373/74 |
| 4,132,852 | 1/1979 | Andoniev et al. | 373/74 |
| 4,216,348 | 8/1980 | Greenberger | 373/74 |
| 4,273,949 | 6/1981 | Fischer | 373/74 |

FOREIGN PATENT DOCUMENTS

| | | | |
|---|---|---|---|
| 86817 | 1/1956 | Norway | 373/74 |

*Primary Examiner*—Roy N. Envall, Jr.
*Attorney, Agent, or Firm*—Daniel Patch

[57] ABSTRACT

A fluid cooled roof assembly for an electric arc furnace comprised of at least three circular sector shaped panels having coolant passages and an outer ring member supporting a plurality of connected arcuate ring sectors which extend upwardly away from the interior of the furnace giving added height thereto, and on which the assembled panels are supported in a flat disposition. The circular sector panels, when assembled, are designed to provide ports for receiving the electrodes and come together at a point location in the center of the roof forming a full circle which completely covers the furnace.

6 Claims, 8 Drawing Figures

ROOF ASSEMBLY FOR AN ELECTRIC ARC FURNACE

BACKGROUND OF THE INVENTION

The present invetion relates to a roof assembly for an electric arc furnace used for melting metals and has particular application in a roof assembly of the type where a number of water cooled roof segments or panel units are arranged to have their sides abutting each other and an outer support ring encircles the periphery of the roof.

Past designs for a roof of an electric arc furnace include several different types, the most common being of the spherical dome configuration formed either by refractory bricks or by water cooled panels, such as those roof designs disclosed in U.S. Pat. Nos. 4,021,603 and 4,216,348. Other roof assemblies have roof composites such as refractory bricks or tiles to form a flat disposed roof over the furnace, such as those disclosed in U.S. Pat. Nos. 4,063,028 and 4,132,852.

The central area in most of these past designs is commonly referred to as a "delta area" where the openings or ports for the electrodes are located, and which may consist of an assembly of bricks which may or may not be surrounded by a water cooled inner ring. This electrode area usually is a high wear area. The refractory bricks depend on each other for their support in the spherical dome shaped roof designs and deterioration of any of these refractory bricks could cause collapse of the delta area or would cause failure or collapse of the entire roof especially in the instance where the refractory bricks comprise the entire roof assembly.

In the roof designs which are in a flat disposition, such as that of the above '852 patent, it is still mandatory to replace the refractory bricks frequently after a certain number of heats of the furnace.

In most of the above described water cooled roof designs, refractory bricks are still being used in the delta area since any metal components in this area would have the tendency to overheat as a result of induced electrical currents, thereby resulting in extreme heat build-ups in the metal components; and also the existence of any metal components in this vital area near the electrodes would have the tendency to create arcing between the electrodes and the metal components.

In these dome-shaped configurations for the above described roof designs, the water cooled panels or refractory bricks abut the outer cooled ring means which is supported by the sidewalls of the furnace shell. The proximity of these panels or bricks along the boundary line of the top of the furnace shell with the roof assembly makes these panels or bricks of the roof assembly suspectible to several disadvantages, thereby decreasing the operation of the furnace. These disadvantages are: (1) arc flair reflected from the furnace sidewalls; (2) elevated radiated heat fluxes; (3) mechanical failure and abuse to the components of the roof from charged scrap in the furnace, and (4) electrical arcing from the scrap to the roof assembly due to the closeness of the roof to the scrap.

SUMMARY OF THE INVENTION

Therefore, with the foregoing in mind, it is the primary object of the present invention to provide a new and improved construction for a roof assembly of an electric arc furnace of the aforementioned type which is not afflicted with the previously discussed drawbacks and limitations of the roof assemblies of the prior designs, which includes optimizing the efficiency of the operation of an electric arc furnace.

It is a further object of the present invention to provide a roof assembly for an electric arc furnace which is in a flat disposition with circular sector panels forming a main roof section which is raised further away from the interior of the furnace than most of the prior roof designs, especially the dome-shaped configurations, and which roof assembly has metal components instead of refractory bricks in the delta area.

Another object of the present invention is to provide a roof assembly having a number of circular water cooled panels designed to be assembled to form a delta area and ports for receiving the electrodes, and which circular sector panels are supported by an arcuate ring comprised by a number of sectors.

These and other objects and advantages of the present invention will be better appreciated and understood when the following description is read along with the accompanying drawings which:

DETAILED DESCRIPTION OF THE PREFERRED EMBODIMENT

Figure 1:
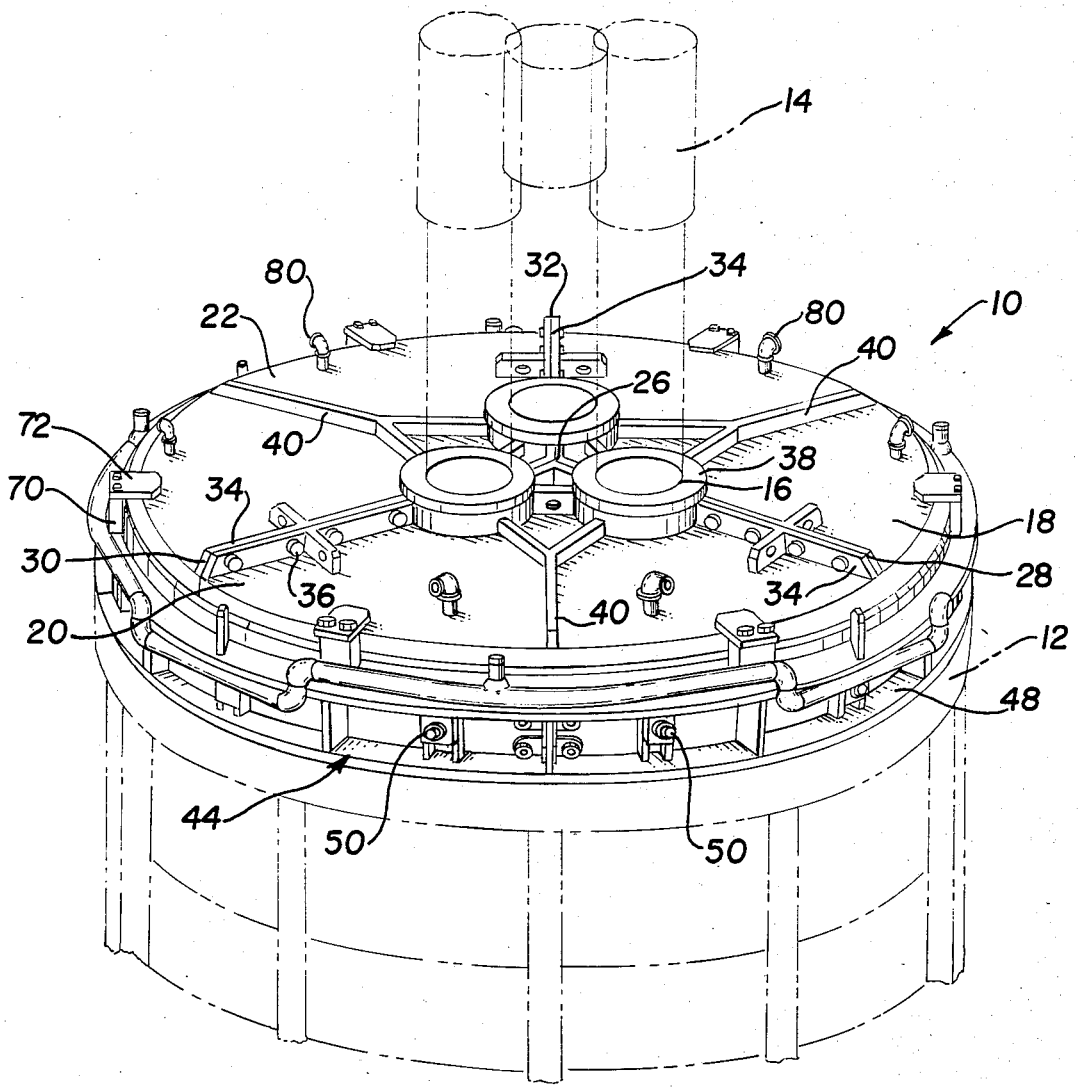
FIG. 1 is a perspective view of the roof assembly for an electric arc furnace of the present invention supported by sidewalls thereof.

The type of electric arc furnace in which the present invention is involved is well known in the art, and therefore as to the construction of the furnace, only the roof assembly will be described with the specificity required to understand the invention. In the drawings the same numbers designate similar components.

Figure 2:
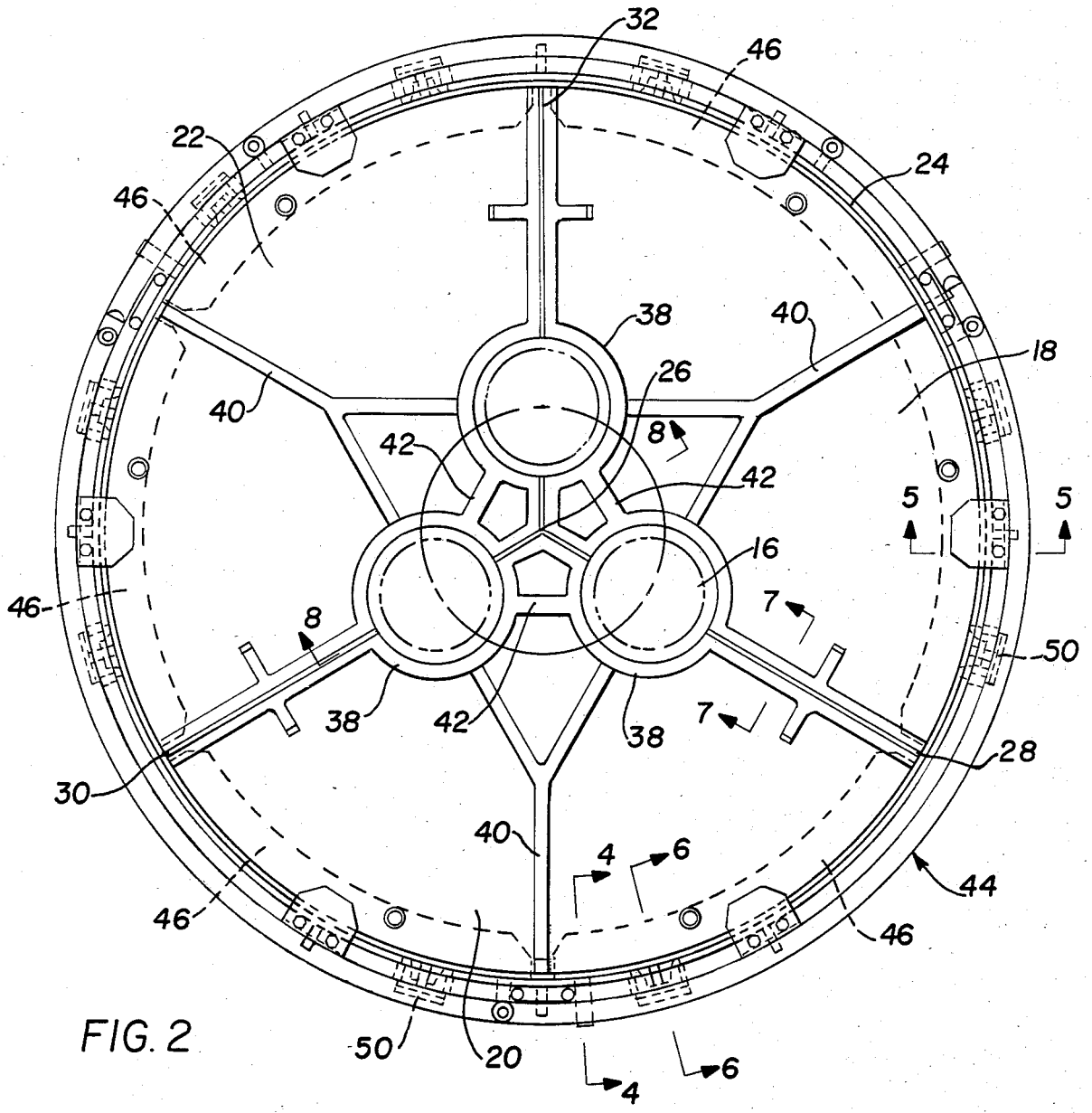
FIG. 2 is a plan view of the roof assembly.

Referring first to FIGS. 1 and 2, there is shown a roof assembly 10 supported by sidewalls 12 shown in phantom of a shell of an electric arc furnace. In the usual procedure, electrodes 14 (one of which is numbered) are lowered down into the interior of the furnace from above the roof through openings or ports 16 in the roof assembly 10. These ports 16 are formed by circular sector shaped roof panel segments 18, 20, 22 having an arcuate base 24 (FIG. 2) and which sectors or segments 18, 20, 22 are made of iron and/or steel and have passageways for carrying coolant similar to those panels disclosed in the above '348 patent and which as particularly shown in FIG. 2 come together at a point location 26 to completely close the top of the roof assembly 10. As illustrated in FIG. 2, the joining line between segments 18 and 20 is shown at 28; that between segments 20 and 22 is shown at 30; and that between segments 22 and 18 is shown at 32.

FIG. 1 shows along these joining boundary lines 28, 30, and 32, rib elements 34 which are formed along opposite longitudinal edges of the panel segments 18, 20, 22 when these segments are cast or fabricated. Rib elements 34 protrude upwardly and abut that of its neighboring panel segment whereby several bolts 36 secure rib elements 34 together.

Figure 8:
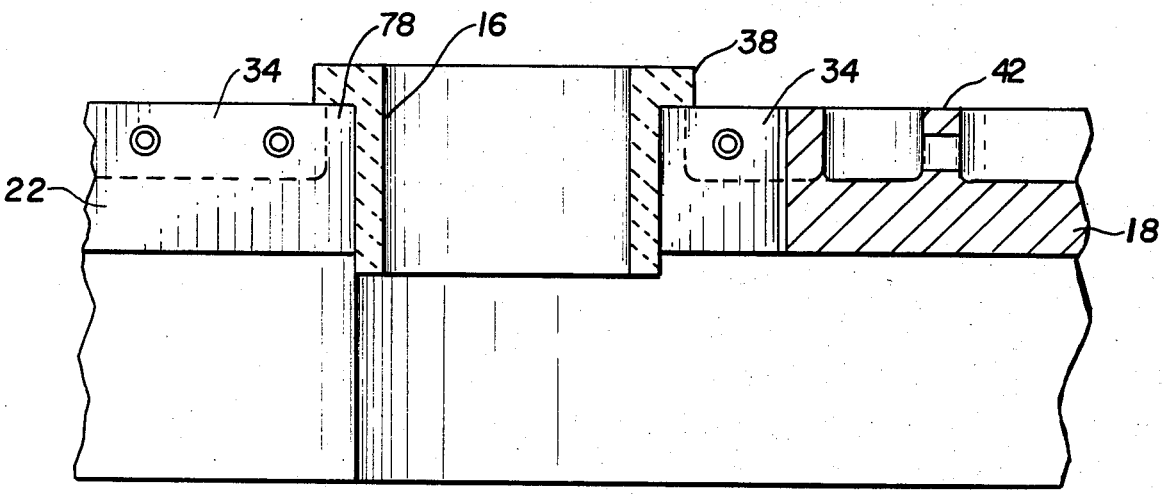
FIG. 8 is a sectional view taken along lines 8—8 of FIG. 2.

Toward the terminus of each pair of cooperating rib elements 34 for two neighboring panel segments toward the center area of roof assembly 10 is a member 38 forming port 16 in the roof for receiving electrode 14. Along the longitudinal edges of each panel segment 18, 20, 22 is an arcuate indentation 39 of an 180° radius whose cooperation with an indentation of its neighboring panel segment forms port 16, into which member 38 extends, (FIG. 8). Member 38 can either be cast or fired refractory sleeve extending beyond the inner surface of the panel segments to form a thermal and electrical insulating barrier between the segments 18, 20, 22 and the electrodes 14.

Rigidity is given to roof assembly 10 by a brace member 40 centrally located in each panel segment 18, 20, 22, which brace member 40 extends from the outermost periphery of its respective panel segment toward the center of the roof where it branches off into a "Y" configuration whose legs are each connected to opposing arcuate indentations 39. As can be seen in FIG. 1, brace members 40 form a triangle or a delta area which encompasses the electrode ports 16. Inwardly of the delta area and outwardly from where the three panel segments 18, 20, 22 converge at point 26 are brace members 42 (shown in FIG. 2), each spanning opposed ports 16. The center area where point 26 is located is formed by a portion of each rib element 34 (FIG. 1) extending beyond arcuate indentation 39.

Figure 3:
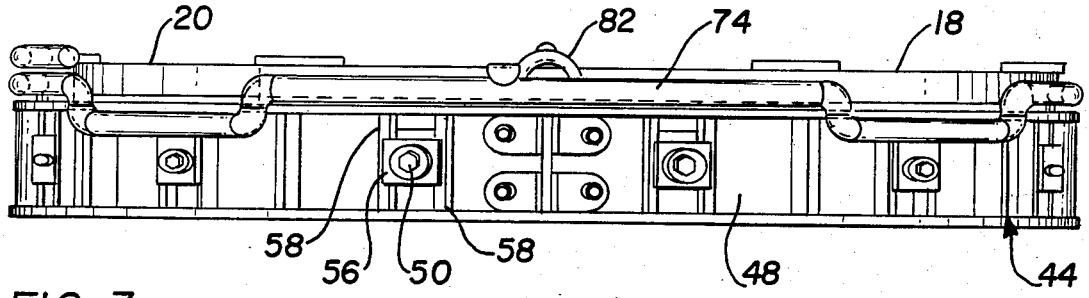
FIG. 3 is an elevational view of FIG. 2.

As FIGS. 1, 2, and 3 particularly show, panel segments 18, 20, 22 are arranged in a flat or horizontal attitude and are supported by ring means 44 which encircles the outer periphery of roof assembly 10. As best seen in FIG. 2, ring means 44 is comprised of a number of arcuate ring sectors 46, and ring member 48, as particularly shown in FIGS. 4, 5, and 6. As seen in FIGS. 2, 3, and 6, each arcuate sector 46 is fastened to ring member 48 of ring means 44, at connection means 50.

In FIG. 6, connection means 50 has an ear 52 protruding through an opening in ring member 48, which ear 52 receives a bolt extending through a washer 54 and brace plate 56.

As FIG. 3 shows, brace plate 56 spans elongated members 58 located along the outside of ring member 48, which is a fabricated structural member, and having several such elongated members 58. Ring member 48 with arcuate ring sectors 46 are supported on the sidewalls 12 of the furnace shell.

Figure 4:
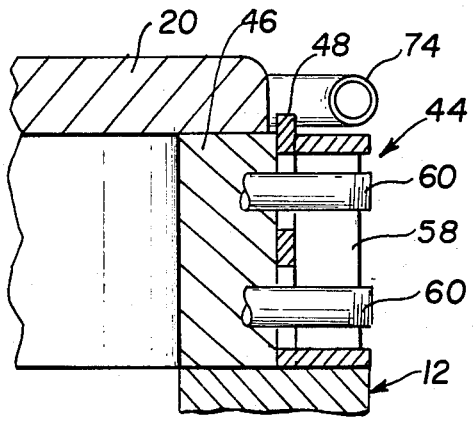
FIG. 4 is a sectional view taken along lines 4—4 of FIG. 2.

As particularly seen in FIG. 4, pipes 60 protrude through member 48 and extend into arcuate ring sector 46, which pipes 60 through suitable means are connected to pipe means 74 located on and around outer ring means 44, and which are further connected to those pipes shown leading into the channels or passageways existing in panel segments 18, 20, 22 for circulating the cooling medium through the components of roof assembly 10, including the delta area and extending near juncture 26.

Figure 7:
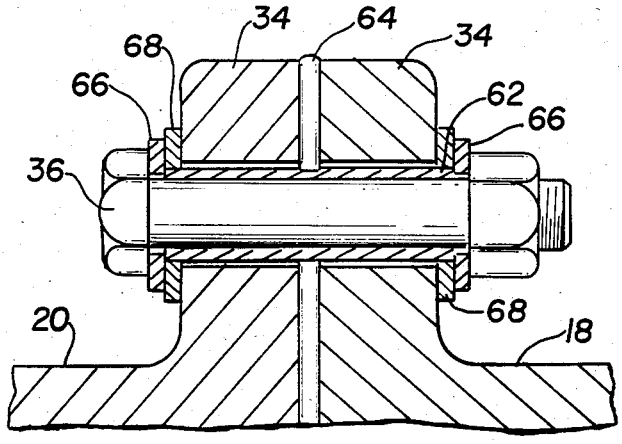
FIG. 7 is a sectional view taken along lines 7—7 of FIG. 2.

As mentioned above, each circular sector 18, 20, 22 is connected to its adjacent sector by bolts 36. FIG. 7 shows one such bolt 36 extending through a collared sleeve 62 spanning a pair of rib elements 34 of adjoining panel sectors 18 and 20. Needless to say, each bolt 36 is mounted in sectors 18 and 20 similar to that shown in FIG. 7, and carries nut 37 at its one end. In order to decrease or eliminate electric arcing, thermal and electrical insulation packing means 64 is provided between rib elements 34. The type of material for the thermal and electrical insulation may be one of those available in the market. Washers 66, collars 68, and sleeve 62 are also made of an electrically insulating material well-known in the industry.

Figure 5:
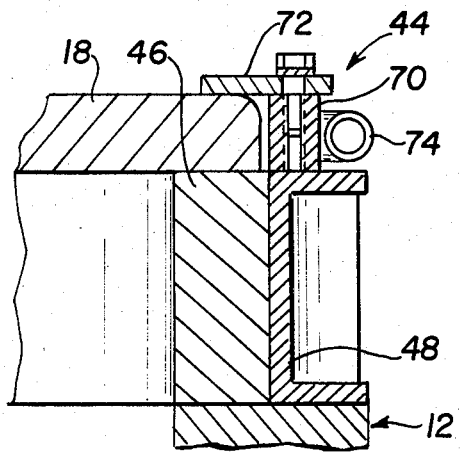
FIG. 5 is a sectional view taken along lines 5—5 of FIG. 2.
Figure 6:
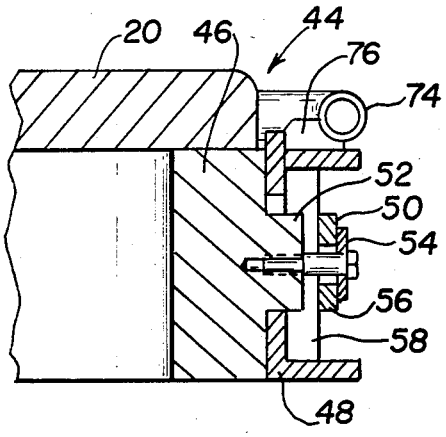
FIG. 6 is a sectional view taken along lines 6—6 of FIG. 2.

In FIGS. 1 and 5, panel segments 18, 20, 22 are supported by arcuate ring sectors 46 of outer ring means 44 and held by fastening means which consists of an extension member 70 extending upwardly from ring member 48 of outer ring 44. Extension member 70 has a plate 72 cantileverly extending over panel segment 18 and is adjusted relative to panel segment 18 by bolts inserted through plate 72 and extension member 70. Conduits 74 carrying coolant to and from the metal components of roof assembly 10 are supported around the outer periphery of roof assembly 10 by a number of brackets 76 mounted on outer ring member 48, as particularly seen in FIG. 6.

As stated earlier, and with reference to FIG. 8, member 38 has a sleeve and a collar, both of an insulating material. The opposed arcuate indentations 39 of each panel segment 18–22 cooperating with that of the adjacent panel segment to form port 16 has an upward portion 78 supporting member 38.

Referring again to FIG. 1, panel segments 18, 20, 22 have conduit connections only one of which is numbered 80 extending from their upper surface. As is apparent, these conduits 80 are connected through suitable conduit connecting means to the outer conduits 74 encircling the perimeter of roof assembly 10 and supported by outer ring means 44.

As mentioned earlier and as evidenced by conduits 80, each panel segment 18, 20, 22 has passageways for conveying water through the main roof section, and these passageways may be formed during the casting or fabrication of the circular panel segments 18–22, such as disclosed in some of the above mentioned patents. These passageways are such as to extend in the portion of the panel segments 18, 20, 22 forming the traditionally known "delta area" of roof assembly 10 thereby permitting cooling of the electrode area.

Assemblage of the components of roof assembly 10 is done in a conventional manner on the plant floor and is lifted by means such as handles 82 (FIG. 3) as a unit in the usual manner by an overhead crane and placed on the sidewalls 12 of the furnace, where panel segments 18, 20, 22 are in a flat position. As alluded to and as shown in the Figures, this flat disposition of panel segments or sectors 18, 20, 22 with the height of ring means 44 spaces roof assembly 10 away from the interior of the furnace where the roof components are less exposed to the harsh environment caused by the heats of the furnace thus prolonging the life of roof assembly 10 and in particular segments 18–22.

Since very little refractory material exists in the roof assembly 10, roof assembly 10 is free from critical refractory areas which upon erosion thereof would result in a total or partial collapse of the roof.

The type of insulation packing in ports 16 of the roof assembly 10 provides both electrical insulation to prohibit arcing between the panel segments 18, 20, 22, and the electrodes; and also some thermal insulation to protect the roof components from the extreme heat conditions of the electrodes.

The height for ring means 44 would be dependent upon such variables as scrap charging capacity, electrode cooling and overhead restrictions in the plant where the furnace is located. In most cases, this dimension would be comparable to the highest elevational point of the inner surface in a dome-shaped roof of the present day designs.

Roof assembly 10 of the present invention shown in FIGS. 1–3 where segments 18, 20, 22 are in a flat disposition has particular application in a furnace having a maximum diameter of twelve feet. A furnace having a greater diameter may use with little or no modifications roof assembly 10 as a delta area instead of the main roof section as described herein.

While the present invention has been disclosed in connection with the preferred embodiment thereof, it should be understood that there may be other embodiments which fall within the spirit and scope of the invention as defined by the following claims.

In accordance with the provisions of the patent statutes, I have explained the principle and operation of my invention, and have illustrated and described what I consider to represent the best embodiment thereof.

I claim:

1. A fluid cooled roof assembly for an electric arc furnace where electrodes are inserted in the interior of the furnace, which furnace has sidewalls for holding metal scrap and which roof assembly has conduits for bringing to and carrying away coolant from said roof assembly, comprising:

outer ring means defining the outer periphery of said roof and constructed and arranged in a manner to rest on said sidewalls of said furnace and to extend upwardly away from said sidewalls giving added height to said furnace, and a number of circular panel sectors connected together to form a main roof section for said roof assembly and associated to said outer ring means and secured to each other in a manner such that said roof assembly is in a relatively flat disposition covering the top of said furnace, said each panel sector being in a triangular shape and having opposed outer longitudinal edges along which an indented area is formed upon which when said panel sectors are assembled said indented area cooperates with an indented area of an adjacent panel sector to form an opening for said insertion of one of said electrodes, said each panel sector further having an area along its said opposed longitudinal edges inwardly of said indented area which upon said connection of said panel sectors mate with that of its said adjacent sector to form a central juncture and a central electrode area encompassing said formed electrode openings.

2. A fluid cooled roof assembly according to claim 1, wherein said outer ring means consists of a plurality of arcuate ring sectors and an outer ring member whereby said arcuate ring sectors are attached, and wherein said panel sectors are supported on said arcuate ring sectors.

3. A fluid cooled roof assembly according to claim 1 further comprising:

means along said longitudinal edges of said each panel sector for connecting said sector to its said adjacent sector, and insulation means arranged in said electrode openings and between arranged said panel sectors along their said longitudinal edges to provide at least electrical insulation between said panel sectors and said electrodes.

4. A fluid cooled roof assembly according to claim 1, wherein said inward area of said panel sectors at said formed juncture are constructed and arranged such as to fully close the top of said roof assembly and thus said furnace.

5. A fluid cooled roof assembly according to claim 1 wherein said each panel sector includes means for carrying cooling fluid throughout said roof section including said central electrode area thereof.

6. A fluid cooled roof assembly according to claim 2, wherein said outer ring means includes means for carrying cooling fluid throughout said roof assembly and therein.

* * * * *